US005103703A

United States Patent [19]

Littleton

[11] Patent Number: 5,103,703

[45] Date of Patent: Apr. 14, 1992

[54] WEB SEVERING APPARATUS AND METHOD

[75] Inventor: Francis J. Littleton, Alden

[73] Assignee: Littleton Industrial Consultants, Inc., Alden, N.Y.

[21] Appl. No.: 593,207

[22] Filed: Oct. 5, 1990

Related U.S. Application Data

[63] Continuation-in-part of Ser. No. 493,472, Mar. 14, 1990, abandoned.

[51] Int. Cl.[5] ..... B26D 1/62

[52] U.S. Cl. ..... 83/155; 83/303; 83/346; 83/404; 83/100

[58] Field of Search ..... 83/33, 49, 100, 102, 83/102.1, 150, 152, 155, 303, 346, 404, 406.1, 920

[56] References Cited

U.S. PATENT DOCUMENTS

| | | | |
|---|---|---|---|
| 1,532,538 | 4/1925 | Langston . | |
| 2,311,692 | 2/1943 | Potdevin | 83/303 |
| 3,159,069 | 12/1964 | Winkler et al. | 83/302 |
| 3,544,454 | 12/1970 | Muth et al. | 83/303 |
| 3,762,254 | 10/1973 | Tsymbal et al. | 83/158 |
| 4,151,699 | 5/1979 | Focke et al. | 53/228 |
| 4,388,794 | 6/1983 | Focke et al. | 53/389 |
| 4,785,696 | 11/1988 | Martiny | 83/152 |
| 4,983,155 | 1/1991 | Stobb | 83/155 |

*Primary Examiner*—Douglas D. Watts
*Assistant Examiner*—Scott A. Smith
*Attorney, Agent, or Firm*—Sommer, Oliverio & Sommer

[57] ABSTRACT

Sheet cutting apparatus for severing a rapidly-moving web, such as printed paper, into cut sheets in two stages. In the first stage, spaced cuts are made along a transverse cutting line of the web. The web is trained between belts which support the cut portions of the web, and the uncut portions of the web are severed to separate sheets. The sheets are conveyed out of the cutting station and into further apparatus. Preferably, the belts for supporting the web during the second cutting operation are trained around the knife and anvil rolls which make the cuts. The purpose of the belts is to prevent the leading edge of the web or a cut sheet from being projected forward of its support, thus tending to become dog-eared or misfed. The cuts made at the first and second cutting stations can be arranged in various patterns to remedy mis-timing of the respective cutting stations.

7 Claims, 4 Drawing Sheets

FIG. 3
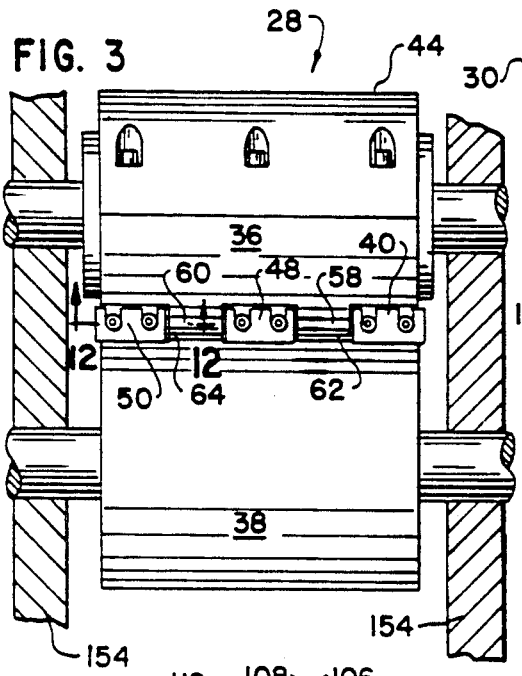
FIG. 4
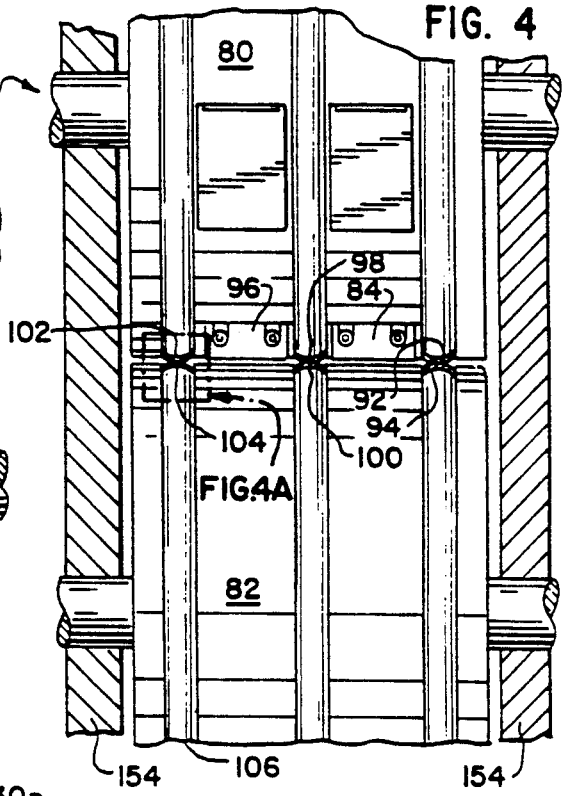
FIG. 4A
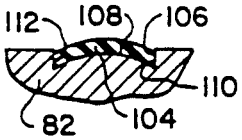
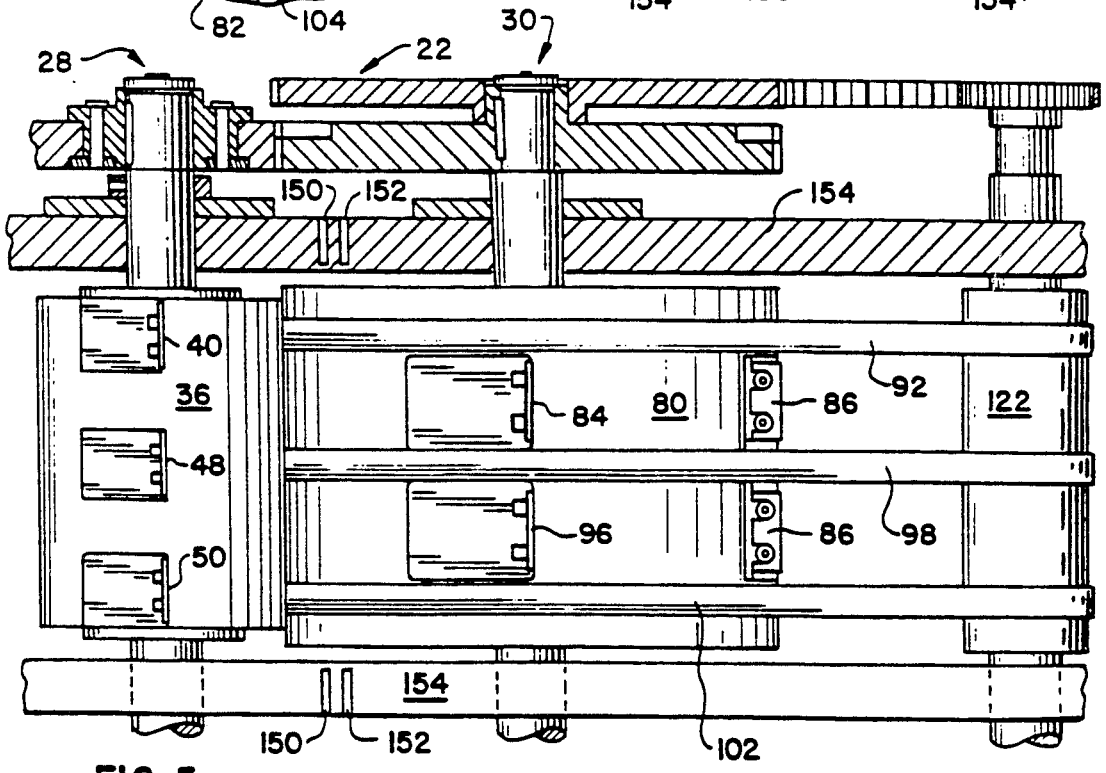
FIG. 5

FIG. 6
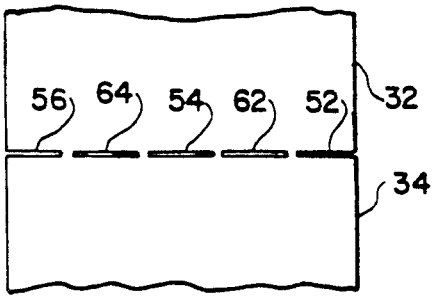
FIG. 7
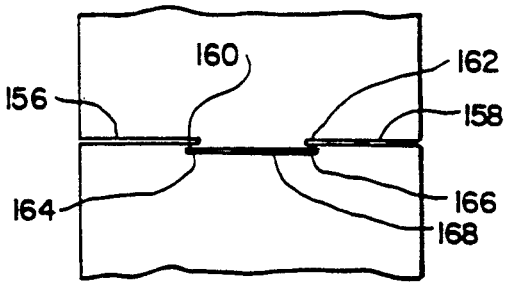
FIG. 8
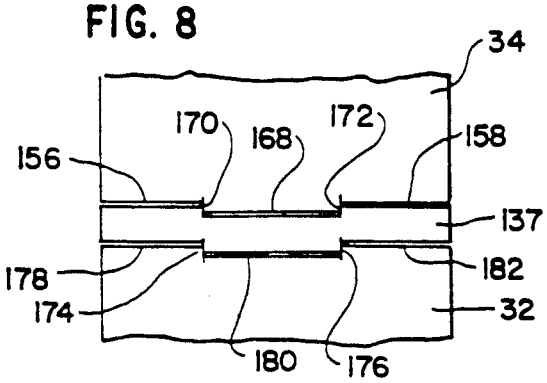
FIG. 9
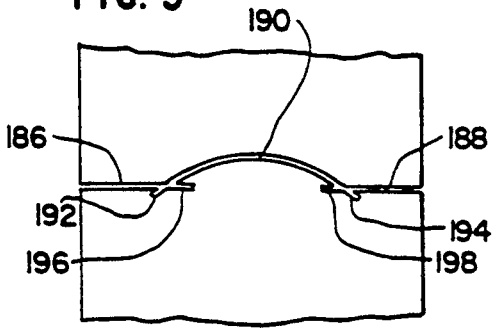
FIG. 10
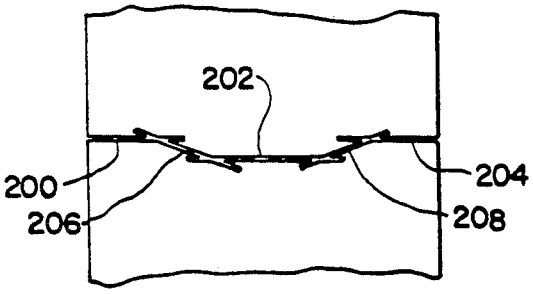
FIG. 11
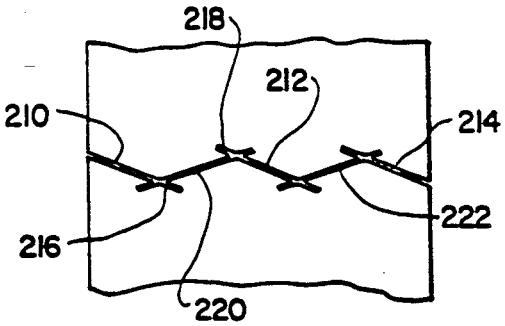
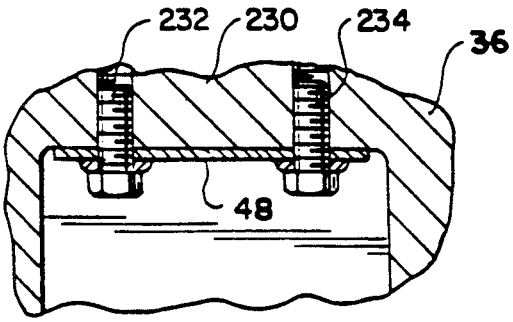
FIG. 12
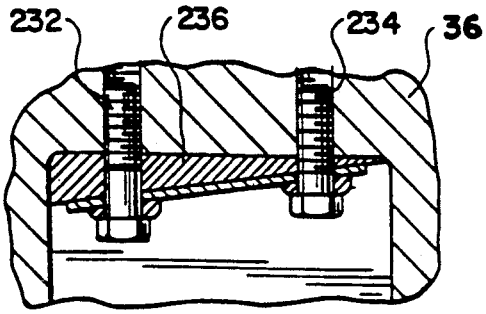
FIG. 13

WEB SEVERING APPARATUS AND METHOD

CROSS-REFERENCE TO RELATED APPLICATIONS

This application is a continuation-in-part of U.S. Ser. No. 07/493,472, filed Mar. 14, 1990, now abandoned.

SUMMARY OF THE INVENTION

The present invention relates to apparatus and a method for cutting a rapidly-moving web of material, such as paper, into individual sheets. The invention relates more particularly to such apparatus which makes part of the cut separating a sheet from the web at a first station and the remainder of the cut at a second station.

U.S. Pat. No. 4,151,699, issued to Focke et al. on May 1, 1979, teaches a sheet cutter for cutting blanks of cellophane from a web. The cut blanks are used for wrapping packages. Focke severs the web by transverse cuts made at two stations. Two separated cuts are made in the web at a first station, after which the web is advanced to suction belts aligned with the cuts. The belts hold the cut edges of the partially-severed sheet and advance the sheet to a second cutting station which completes the transverse cut. The suction belts then advance the severed sheet across the path of an article to be packaged. The moving suction belt must be drawn against a stationary vacuum shoe to immobilize the web and cut sheet on the belt.

U.S. Pat. No. 4,388,794, issued to Focke et al. on June 21, 1983, appears to show similar apparatus.

U.S. Pat. No. 1,532,538, issued to Langston on Apr. 7, 1925, shows apparatus used to cut a web of shingles. The shingle web lays on a belt when the final cut severing a sheet is made so that forwardly-depending flaps previously formed in the shingles do not droop and then fold over in the machine.

Another reference relating to the severance of sheets from a web is Winkler et al., U.S. Pat. No. 3,159,069, issued Dec. 1, 1964.

One problem in the field of cutting a rapidly-moving web of material, such as a web of printed paper, into uniform separate sheets is support and control of the leading edge of the sheet from the time the leading edge is formed until the sheet is decelerated. For at least some of this time, the leading edge is unsupported. This rapidly-moving, unsupported leading edge can be diverted from its intended path by the surrounding air, thus misfeeding the sheet. The leading edge or its corners can fold over or become dog-eared. The result can be a ruined sheet, or worse, a jammed machine which must be shut down to remove the dog-eared sheet.

This problem has particular application in equipment for handling and subdividing a multilayered web of paper which moves extremely fast through the equipment. For example, in web printing equipment used for printing newspapers, web speeds in excess of 1000 feet per minute will form dog-eared sheets, yet web speeds up to 2200 feet per minute are used. A stack of ribbons or sheets with unconfined leading edges will open up at high speed, allowing air to enter and separate the individual sheets. The separated sheets are flimsy and easily folded over. The entire web may fold over, as well.

Another aspect of this problem involves the handling of folded multiple-layer webs. An example is a web which is to form an eight page signature, formed by registering two webs to form a two-sheet web and folding the two-sheet web longitudinally to form a four-sheet web with a fold running longitudinally down one side and free edges of the sheets running longitudinally down the other side.

A multiple-layer web is often formed as a lapped web to facilitate handling. A lapped web is longitudinally folded unequally so at least one of the sheets on one side of the fold overlaps or extends further from the fold than the facing sheets on the other side of the fold.

A full-lap web is formed if every sheet of the unfolded web is the same width and is folded unequally so all the sheets on one side of the fold are longer and coextensive, while all the sheets on the other side of the fold are shorter and coextensive. A false-lap web is formed by providing one sheet which is wider than the others and folding the stacked sheets so every sheet on one side of the fold and all but one sheet on the other side of the fold are coextensive. The wider sheet is folded so the sheet on one side of the fold is coextensive with all the other sheets and the sheet on the other side of the fold extends beyond ("laps") all the other sheets of the signature.

The lapped portion of the signature can be grasped, and even damaged to some degree, for after the signature web is severed along transverse lines to form individual signatures, they are trimmed to remove the laps. However, any lap, and particularly a full lap, represents a large waste of paper which is later trimmed away. Thus, it would be desirable to provide false laps instead of full laps when laps are desired. False-lap webs also can be handled by suction more readily than full lap webs, since suction can only handle one ply of a multiply web.

Unfortunately, existing equipment cannot run false-lap webs at high speeds because the lapped edge is a single sheet which has a leading edge and thus is very prone to dog-earing. Full-lapped webs must be run and the two or more laps must be trimmed as waste.

The dog-earing problem is currently overcome by using a static inducer to charge the individual ribbons of the web, causing them to adhere. The adhered ribbons form a relatively-rigid web whose leading edge can be unsupported between the knife roll and a tape nip. Unfortunately, once charged, the cut sheets are difficult to separate. Also, the lapped edge of a false-lap web cannot be supported by static adhesion to other sheets because it does not overlie any other sheet of the web.

Still another problem not addressed by the prior art is how to make successive cuts to cleanly sever the web despite slight mistiming of the first and second cutting stations.

OBJECTS OF THE INVENTION

It is a general object of this invention to provide apparatus for cutting sheets from a web in two stages while controlling the edges of the web and cut sheet to avoid misfeeding or folding the sheet as it is conveyed to further apparatus.

It is another object of this invention to provide apparatus which can sever a false-lap web into signatures at high speed, while avoiding misfeeding or folding the lap.

It is yet another object of this invention to provide facing conveyor belts associated with the final cutting roll to constrain the already-cut portions of the web while the remaining sections of the web are severed.

It is a further object of this invention to provide apparatus which severs sheets from the web in at least two stages, with the lines of severance being so arranged that a slight deviation in the relative timing of the respective cutting stations will not prevent the web from being cleanly severed.

It is a further object of this invention to minimize contact between moving and stationary elements of the apparatus, such as the contact between a suction belt and vacuum shoe, while accomplishing the other aims of the invention.

Other objects and advantages of the invention will become apparent upon reading the following detailed description and appended claims and upon reference to the accompanying drawings.

SUMMARY OF THE INVENTION

The present invention overcomes the problems and limitations associated with the prior art by employing a facing pair of conveyor belts wrapped about and recessed in the cutting roll and anvil roll which cooperate at a nip to produce the final cut of the web. The facing belts then convey the cut sheet downstream of the final cutting station and into further apparatus for decelerating, overlapping, and stacking the cut sheets. Another aspect of the invention is apparatus and methods employing skewed, curved, or longitudinally-extending cutting knives to allow a substantially clean cut to be made despite slight mis-timing of two cutting stations. The invention is particularly well adapted to handling false-lap webs which have both single-thickness and multiple-thickness portions in any transverse section.

BRIEF DESCRIPTION OF DRAWINGS

For a more complete understanding of this invention, reference should now be made to the embodiment illustrated in greater detail in the accompanying drawings, in which:

FIG. 3 is a section taken along line 3—3 of FIG. 2, showing the knife and anvil rolls of the first cutting station in elevation.

FIG. 4 is a section taken along line 4—4 of FIG. 2, showing the knife roll, anvil roll, and belts of the second cutting station in elevation.

FIG. 4A is a fragmentary enlarged detail view of the left belt and recess shown in FIG. 4.

FIG. 5 is a section taken along line 5—5 of FIG. 2, with the web removed, showing the web path viewed from below with respect to FIG. 2.

FIG. 6 is a plan view of a web showing a pattern of cuts for severing the web according to the present invention.

FIGS. 7-11 are views like FIG. 6 of alternative patterns of cuts according to the present invention.

FIG. 12 is a section taken along line 12—12 of FIG. 3, showing a knife in its holder.

FIG. 13 is a view like FIG. 12 showing an alternate embodiment of the knife and holder.

DETAILED DESCRIPTION OF THE INVENTION

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the claims.

Figure 1:
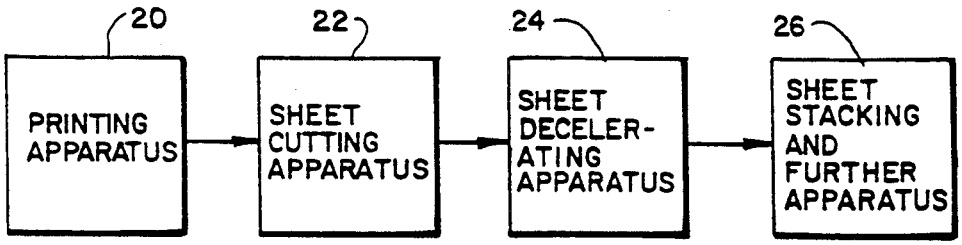
FIG. 1 is a flow diagram showing the environment in which the invention is found.

FIG. 1 is a flow diagram showing the relation of the present invention to its environment. An unbroken web of paper is fed into the printing apparatus 20, which forms no part of the present invention and might be omitted if the invention is used to sever a web into blank sheets. The printed sheet from the printing apparatus 20 is fed into sheet cutting or sheeting apparatus 22 according to the present invention. A continuous web of paper fed into the apparatus 22 is cut into individual, typically-uniform printed sheets, such as the individual sheets of a newspaper, magazine or book. (The term "individual sheets" used herein does not exclude multi-layer webs, which will form individual stacks of sheets when severed.) The individual sheets severed from the web are transferred from the sheet cutting apparatus 22 to sheet decelerating apparatus 24, and from there to further apparatus generally indicated at 26.

One preferred form of sheet decelerating apparatus which forms an overlapped stack of sheets for further processing is shown in my application, U.S Ser. No. 07/204,698, filed June 9, 1988, now U.S. Pat. No. 4,969,640, which is hereby incorporated herein by reference.

Figure 2:
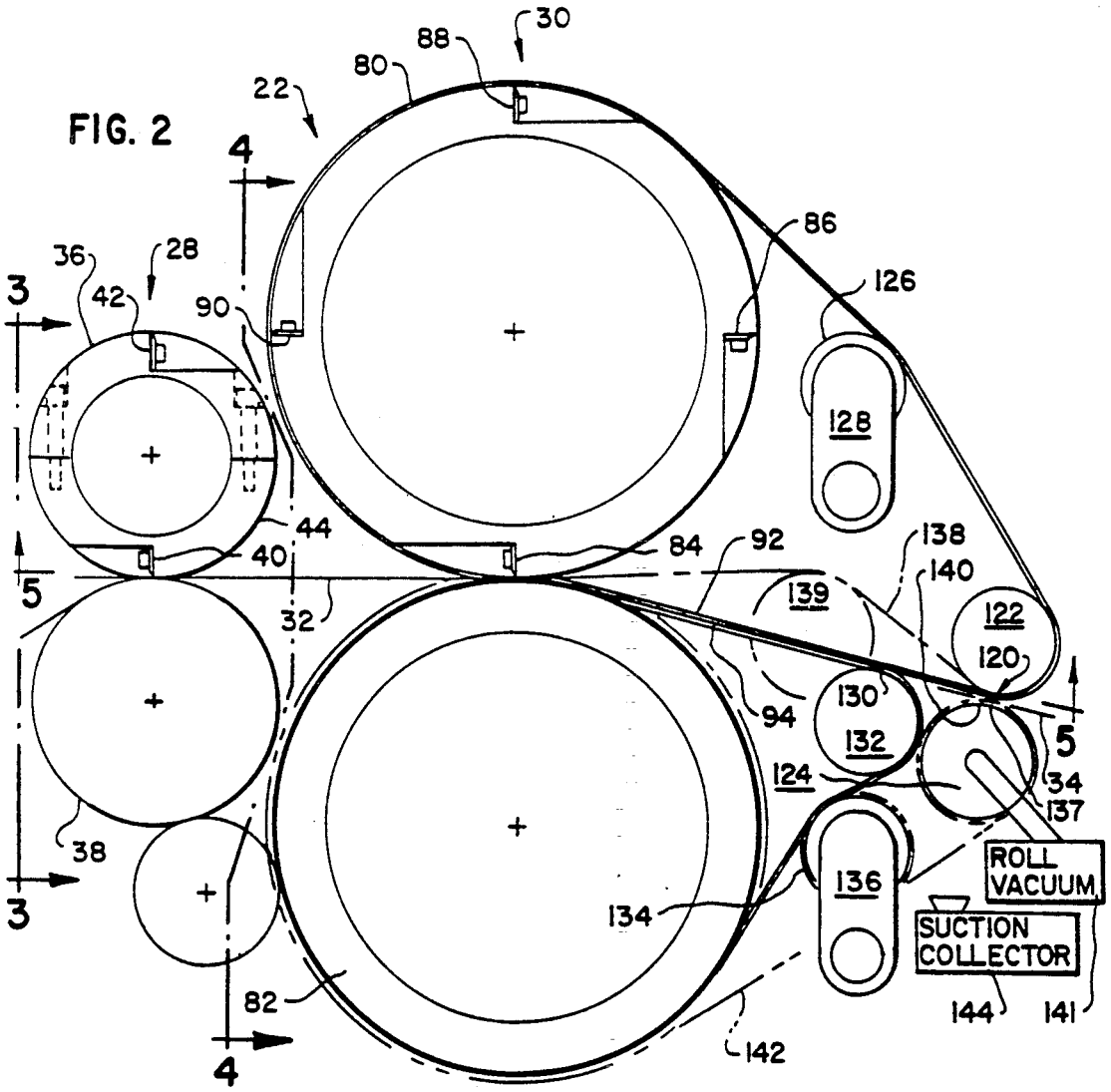
FIG. 2 is a schematic side elevation of the cutting apparatus of the present invention, with frames, roll drives, and other elements removed to show underlying structure.

Referring now to FIG. 2, the apparatus 22 is divided into a first cutting station, generally indicated at 28, and a second cutting station, generally indicated at 30. The cutting stations operate on a web 32 which enters the sheet cutting apparatus 22 from the left of FIG. 2. Individually-cut sheets 34 exit the apparatus to the right to enter the further apparatus 24 and 26 of FIG. 1.

The first cutting station 28 comprises a knife roll 36, sometimes referred to herein as a first knife roll, and an anvil roll 38. The first knife roll 36 carries knives, such as 40 and 42, which are 180) apart in this embodiment. For apparatus to handle a 45 inch (114 cm) web, the diameter of the knife roll 36 may be doubled to provide adequate transverse rigidity of the roll 36. The knives, such as 40 and 42, will be provided at 90) intervals in that embodiment.

Each knife, such as 40, is recessed within the outer margin 44 of the roll. The anvil roll 38 has a polyurethane rubber or other yieldable surface which receives each knife, such as 40, at the nip between the rolls 36 and 38. The interaction between the knife roll 36 and the anvil roll 38 on opposite sides of the web 32 partially severs the web, leaving a cut congruent with the blade of the knife 40.

Now referring to FIGS. 2, 3, and 6, the first cutting station 28 comprises three transversely-spaced knives 40, 48, and 50, each aligned to cut transversely with respect to the direction of movement of web 32. The knives 40, 48, and 50 partially sever the web along segments 52, 54, and 56 shown in FIG. 6.

The rings 58 and 60 of the roll 36 between the knives 40, 48, and 50 abut the segments 62 and 64 of the web 32. The rings 58 and 60 are made of a resilient material such as polyurethane rubber, and urge the web 32 against the anvil roll 38 to drive the web forwardly during the engagement of the cutting roll 36 with the web 32.

Referring now to FIGS. 2 and 4, the second cutting station 30 will now be described. The knife roll 80 and the anvil roll 82 of the station 30 are similar to the corresponding rolls of the first cutting station 28. One difference is that the rolls 80 and 82 have a larger diameter than the respective rolls 36 and 38 in this embodiment, and therefore turn at a slower angular velocity and require four knife stations, represented by knives 84, 86, 88, and 90. (Alternately, the knife roll 80, the knife roll 36, and the corresponding anvil rolls may be the same size and the knife rolls may have the same number of knives about their circumferences.) A second difference in the second cutting station 30 is the provision of first and second facing belts 92 and 94 which are further described below.

Another difference, with reference to FIGS. 4 and 6, is the positioning of the knives 84 and 96. These knives respectively perforate the web along the transversely-separated regions 62 and 64, and slightly overlap the cuts 52, 54, and 56. Since the cuts in the web segments 62 and 64 shown in FIG. 6 are intended to cleanly sever the web 32, they are slightly longer than shown in FIG. 6 to intersect the ends of the respective cuts 52, 54, and 56. Alternatively, the web 32 and cut sheet left by the cuts shown in FIG. 6 can be joined by narrow webs of material which can be broken by momentarily accelerating the cut sheet 34 with respect to the web 32. However, it is preferred herein to sever the web completely using only the knives at the cutting stations.

In the second cutting station 30, a facing pair of belts, such as 92 and 94, are provided to accept, support and control the newly-exposed web edges adjoining the transversely-cut regions 52, 54, and 56 of the web. Looking now at FIGS. 4 and 6, the previously-described belts 92 and 94 receive the cut portion 52 of the web, the belts 98 and 100 receive the cut portion 54 of the web, and the belts 102 and 104 receive the cut portion 56 of the web.

As best shown in FIG. 4A, to prevent transverse creeping of the belts, they are preferably carried in grooves-such as 106-which have a crowned floor 108 and side walls 110 and 112. The crowned floor 108 causes the edges of the belt to bend inwardly, thus ensuring that the edges of the belt are engaged by the side walls 100 and 112 of the groove 106. At the nip between the rolls 80 and 82, the belts, such as 92 and 94, serve the same function as the resilient rings 58 and 60 of the knife roll 36.

Referring again to FIG. 2, the belts, such as 92, are wrapped around a substantial portion of the circumference of the knife roll 80, and contact the web 32 and cut sheet 34 substantially from the nip between the rolls 80 and 82 to the nip 120 between the turning roll 122 and the timed roll 124. The belts, such as 92, may continue into a divert or slow-down section (shown schematically in FIG. 1) before being turned. After traversing the turning roll 12, the belt 92 traverses the belt-tensioning roll 126. The roll 126 is journaled at each end to slides 128 which are movable vertically to bear more or less against the belts, such as 92, and vary the belt tension and circumference. The belt then returns around the knife roll 80.

Similarly, the belt 94 is wrapped around a substantial proportion of the circumference of the anvil roll 82, and engages the web 32 and cut sheet 34 between the nip of rolls 80 and 82 and a point, generally indicated at 130, on the turning roll 132. The turning roll 132 is upstream of the nip 120 at which the belt 92 leaves the cut web 34. From the turning roll 132, the belt 94 passes over a tensioning roll 134 which is journaled at each end to slides 136 to allow the tension of the belt to be adjusted. The belt 94 then wraps about the roll 82.

I have found that in some instances the belt 94 may be turned away from the web upstream of the point where the belt 92 is turned away from the web, so the leading edges of the cut sheets are guided only by the belt 92 for a short time. The dog-earing problem most acutely affects the upper sheets of a stack of sheets, so the greatest need for the direct contact of a belt with the stacks of sheets exists on the tops of the stacks.

In many printing operations, portions of the printed web between the impressions are marred, and must be trimmed from the sheets. It is expedient to carry out this trimming step when the web 32 is severed into sheets. To trim the web while it is cut, the knives at the cutting stations are doubled to provide the pattern of cuts shown in FIG. 8 and further described below. This produces trim 137 between each pair of sheets 34, such as the two adjacent sheets 34 shown near the roll 124 in FIG. 2. The trim 137 is removed as follows.

The roll 124 is driven by timing belts, such as 138, trained around the anvil roll 82 and tensioned by a tensioner 139. The timing belts 138 run transversely between the belts, such as 92, and the belts, such as 94. The roll 124 is timed so that its sector 140 receives the trim strip 137. The sector 140 either has an extendable transverse row of pins or a vacuum source, schematically illustrated as 141, which causes the strip 137 to adhere to the roll 124 and be drawn out of the plane of the sheets 34. As the lower runs 142 of the timing belts 138 leave the roll 124, the trim strip 137 can be stripped from the sector 140 by the lower runs 142 and can be collected for disposal by a suction collector, schematically shown as 144.

The arrangement of the respective cuts 52, 54, 56, 62, and 64 shown in FIG. 6 will now be described in further detail and alternate embodiments of the invention will be described.

The cuts made at the respective cutting stations preferably overlap or intersect to form a complete cut. If the knives, such as 40 and 84, of the cutting stations 28 and 30 are substantially perfectly timed and aligned, the several cuts shown in FIG. 6 will form a single cut exactly along a transverse or cross-machine direction severance line. However, it is difficult to exactly adjust the cutting stations so a perfectly transverse cut can be made at two stations to sever the web. One way of improving the timing of the cutting means is to use anti-backlash ring segments in the drive gears of the cutting rolls.

Another means to improve timing is the thermal adjustment apparatus described in my U.S. Pat. No. 4,527,473, issued July 9, 1985, which is hereby incorporated herein by reference. Referring to FIG. 5 herein, heating elements 150 and heat sensors 152 can be installed in the frame members 154 of the cutting apparatus 22 between the first and second cutting stations 28 and 30. My thermal adjustment invention also can be used to adjust the spacing between each knife roll and its anvil roll.

FIG. 7 illustrates a different pattern of cuts in which the two outside cuts, 156 and 158, have ends 160 and 162 which overlap, but do not quite intersect, the corresponding ends 164 and 166 of the middle cut 168. If the overlap, as between the ends 160 and 164, is substantial and the machine direction gap between the ends 160 and 164 is slight, the cuts 156, 158 and 168 may suffice to sever the web. Severance in this manner will be facilitated by providing gain in the second cutting station. Gain is provided by making the surface speed of the rolls 80 and 82 at the nip slightly greater than the surface speed of the rolls 36 and 38.

Another approach to the timing problem is to change the shape or orientation of the cuts. Means for making a slight longitudinal cut, such as the cuts 170, 172, 174 and 176 shown in FIG. 8, will fully sever the web notwithstanding slight misalignment of the cuts 156 and 158 with the cut 168. The cuts 170 and 172 can be made by providing longitudinal elements in the existing knives or by slitting the web longitudinally at another station.

FIG. 8 also illustrates that the first and second cutting stations 28 and 30 can make pairs of parallel cuts, such as 156 and 178, 168 and 180, and 158 and 182, thus severing the web into a cut sheet 34, a leading end 32 of the web, and trim 137.

FIG. 9 shows another pattern of cuts to sever the web. Here, the cuts 186 and 188 made at the first cutting station are straight and accurately transverse and the cut 190 is curved or is another shape projecting slightly in the machine direction so that the ends 192 and 194 will intersect the facing end 196 of the cut 186 and end 198 of the cut 188, despite slight longitudinal misalignment of cuts 186 and 188.

FIG. 10 shows another pattern of cuts designed to allow the web to be cleanly severed, despite slight mistiming of the cutting stations. The parallel cuts 200, 202, and 204 are deliberately stepped slightly out of alignment. Each pair of cuts such as 200 and 202 made by the first cutting station is bridged by a cut, such as 206 made by the second cutting station. The cut 206 and the corresponding knife are skewed about a radial axis of the cutting roll 80 out of parallelism with the cuts 200 and 202 so the ends of the cut 206 overlap the ends of the cuts 200 and 202. The same relation is provided for the cut 208 in relation to the pair of cuts 202 and 204.

For all the skewed, curved, machine direction, or misaligned cuts shown in the present application, the degree of misalignment between the cuts, such as 200 and 202, and the skewing, curvature, or machine-direction extent of cuts, such as 206, is exaggerated for the sake of illustration. The actual separation of cuts 200 and 202 in the machine direction is contemplated to be on the order of 0.01 inches (0.25 millimeters), so any irregularities in the transverse cutting line will not be evident.

FIG. 11 shows another cutting pattern in which the first cuts 210, 212, and 214 are each skewed so that the facing ends such as 216 and 218 of the respective cuts are separated in the machine direction. The cuts 220 and 222 made at the second cutting station are skewed in the other direction, thus intersecting and bridging between the ends such as 216 and 218.

FIGS. 12 and 13 illustrate how the knife mountings can be modified slightly to provide the skewed cuts shown in FIGS. 10 and 11. FIG. 12 shows the knife 48 accurately mounted transverse to the machine direction against a backing 230 by screws 232 and 234. The backing 230 can be machined to support the knife 48 in skewed relation, or a shim 236 can be inserted between the knife 40 and the backing 230 to accomplish the same result. Shims can be used to retrofit a conventional knife roll for practicing the present invention, and can be varied to fine-tune a specific machine.

One particular advantage of the present sheet cutting apparatus 22, employing a facing pair of belts 92 and 94 to control the edges of the cut sheets 34, is that the belts contact only rolls and other elements which move at web speed. This feature is an advantage compared to prior art apparatus employing suction belts to advance the web to the second cutting station. Suction belts require a stationary vacuum shoe which the belts are drawn against to provide suction at the opposite surface of the belt. The moving belt is subject to rapid wear through sliding contact with stationary apparatus. A suction belt also cannot control the stacks of sheets formed when a multilayer web is cut.

Figure 14:
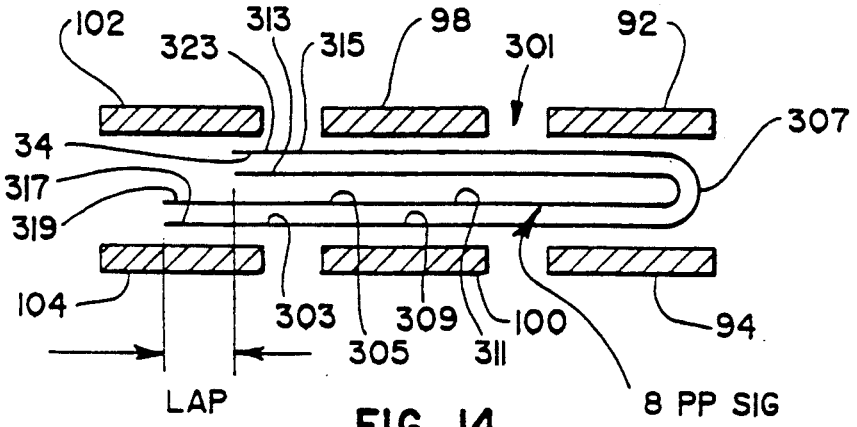
FIG. 14 is a diagrammatic view similar to FIG. 4 of a full-lap web carried between pairs of facing belts according to the present invention.
Figure 15:
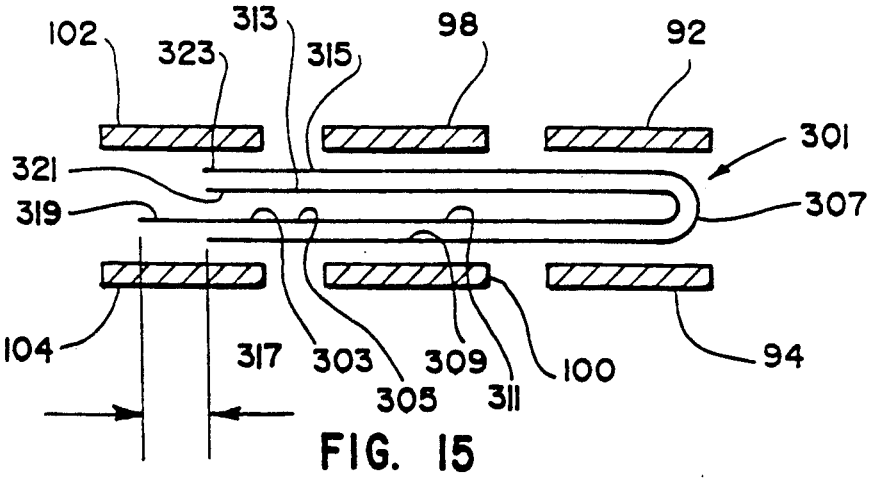
FIG. 15 is a view like FIG. 14, showing a false-lap web carried between pairs of facing belts.

Referring now to FIGS. 14 and 15, the ability of the present apparatus to handle lapped webs, and particularly false-lapped webs, is illustrated. In FIGS. 14 and 15, the belts 92, 94, 98, 100, 102, and 104 are those of the preceding figures. In FIG. 14, the full-lap web 301 has been formed by registering the first and second sheets 303 and 305 while flat to define a two-sheet web and folding the two-sheet web transversely to form the longitudinal fold 307.

The resulting eight-page signature web illustrated in FIG. 14 has the sheets 309 and 311 extending from one side of the fold 307 and the sheets 313 and 315 facing the sheets 309 and 311 and extending from the other side of the fold 307. The edges 317 and 319 of the sheets 309 and 311 overlap or extend beyond the edges 321 and 323 of the sheets 313 and 315. This is a full-lap web because all of the sheets on one side of the fold 307 overlap all those on the other side of the fold.

The parts of the web 307 in FIG. 15 are identically numbered. This false-lap web differs from the full-lap web of FIG. 14 because only the edge 319 extends beyond the other three edges 317, 321, and 323. To make the web 307 of FIG. 15, the sheet 305 is made wider than the sheet 303 and their edges 321 and 323 are registered before the fold 307 is formed.

The false-lap and full-lap webs are each protected against dog-earing, particularly after the signature web 307 is severed transversely to form a leading edge, by the belts 102 and 104, which embrace the lapping edges 317, 319 in FIG. 14 and edge 317 in FIG. 15.

If desired, and with brief reference to FIGS. 4 and 4A, the floors 108 of the grooves 106 supporting the belts 102 and 104 which embrace the lapped portions of the web 307 can have a different radius from the center of the rolls 80 and 82 than the radii of the grooves supporting the belts 92, 94, 98 and 100. Alternatively, belts of different thickness or resiliency can be used to support the lapping edge and full-thickness section of the web. These expedients may be necessary to equalize the gripping force on all parts of the web if the difference in thickness between the lapping edges and the full-thickness portions of the web is significant.

I claim:

1. A sheet cutter for severing a rapidly-moving continuous web of material along periodic severance lines arranged transversely to the direction of web movement to cut individual sheets from said web, said sheet cutter comprising:

a first cutting station operatively arranged to cut at least one first segment from said web along each severance line to partially sever a sheet from said web;

a second cutting station positioned downstream of said first cutting station and operatively arranged to cut at least one second segment from said web along each severance line to completely sever such partially-severed sheet from said web, said second cutting station having a rotatable knife roll and a rotatable anvil roll positioned adjacent said knife roll, said knife roll having at least one knife arranged to selectively engage said angle roll to cut a second segment form said web, each of said knife and anvil rolls having a peripheral recess;

an endless first belt operatively arranged in said knife roll recess; and an endless second belt operatively arranged in said anvil roll recess;

said belts having portions of their respective runs arranged to closely face one another and to move at substantially the same surface speed for guiding said partially-severed sheet through said second cutting station and for supporting proximate portions of said web and partially-severed sheet as each second knife cuts said second segment from said web, each of said belts being aligned along the direction of web movement with each first knife but being non-aligned along the direction of web movement with each second knife.

2. A sheet cutter as set forth in claim 1 wherein each knife is arranged such that each second segment will intersect a marginal end portion of an adjacent first segment.

3. A sheet cutter as set forth in claim 2 wherein each first segment is linear.

4. A sheet cutter as set forth in claim 3 wherein each second segment is linear.

5. A sheet cutter as set forth in claim 4 wherein each second segment will intersect an adjacent first segment at an included angle of less than 180°.

6. A sheet cutter as set forth in claim 1 wherein at least one of said first and second segments is arcuate.

7. A sheet cutter as set forth in claim 1 wherein said belts are arranged to convey said cut sheet from said second cutting station.

* * * * *